US005373690A

United States Patent [19]

Gebhardt

[11] Patent Number: 5,373,690

[45] Date of Patent: Dec. 20, 1994

[54] PROCESS AND DEVICE FOR PNEUMATIC CONVEYING OF FIBERS TO THE FIBER COLLECTION SURFACE OF AN OPEN-END SPINNING ELEMENT

[75] Inventor: Wolfgang Gebhardt, Kosching, Germany

[73] Assignee: RieterIngolstadt Spinnereimaschinenbau AG, Ingolstadt, Germany

[21] Appl. No.: 103,629

[22] Filed: Aug. 6, 1993

[30] Foreign Application Priority Data

Aug. 22, 1992 [DE] Germany ..... 4227884

[51] Int. Cl.[5] ..... D01H 4/30; D01H 4/32

[52] U.S. Cl. ..... 57/411; 57/408; 57/412; 57/413

[58] Field of Search ..... 57/408, 411, 412, 413; 19/200, 203, 204, 205, 296, 304

[56] References Cited

U.S. PATENT DOCUMENTS

| | | | |
|---|---|---|---|
| 3,360,917 | 1/1968 | Kubovy et al. . | |
| 3,557,543 | 1/1971 | Krause . | |
| 3,584,451 | 1/1971 | Chrtek . | |
| 3,800,520 | 4/1974 | Schiltknecht | 57/58.91 |
| 3,943,690 | 3/1976 | Noguera | 57/58.89 |
| 3,968,636 | 7/1976 | Junek et al. . | |
| 4,169,348 | 10/1979 | Blackburn . | |
| 4,249,370 | 2/1981 | Vecera et al. | 57/301 |
| 4,505,102 | 3/1985 | Landwehrkamp et al. | 57/408 |
| 4,704,853 | 11/1987 | Lawrence . | |
| 4,976,099 | 12/1990 | Brockmanns et al. | 57/411 |
| 5,065,572 | 11/1991 | Stahlecker | 57/413 |
| 5,088,266 | 2/1992 | Wassenhoven . | |
| 5,095,689 | 3/1992 | Ferro et al. | 57/263 |

FOREIGN PATENT DOCUMENTS

| | | |
|---|---|---|
| 2131270 | 1/1972 | Germany . |
| 2351825 | 4/1975 | Germany . |
| 2811881 | 9/1979 | Germany . |
| 1357211 | 6/1974 | United Kingdom . |

*Primary Examiner*—Daniel P. Stodola
*Assistant Examiner*—William Stryjewski
*Attorney, Agent, or Firm*—Dority & Manning

[57] ABSTRACT

With pneumatic feeding of fibers to the fiber collection surface of an open-end spinning element, an auxiliary air stream flowing from the immediate proximity of the feeding device to the inlet into the fiber feeding channel is produced and is sufficiently strong so that it removes circling fiber fragments which have been detached from the opener roller. For this purpose, an air conveying channel is provided in the area between the inlet opening of the fiber feeding channel and the feeding device (as seen in the direction of rotation of the opener roller) in the peripheral wall of the housing. This air conveying channel extends from the immediate proximity of the opening in the housing containing the feeding device in housing to the inlet opening of the fiber feeding channel.

16 Claims, 2 Drawing Sheets

PROCESS AND DEVICE FOR PNEUMATIC CONVEYING OF FIBERS TO THE FIBER COLLECTION SURFACE OF AN OPEN-END SPINNING ELEMENT

BACKGROUND OF THE INVENTION

The instant invention relates to a process for pneumatic conveying of fibers to the fiber collection surface of an open-end spinning element whereby a fiber sliver is conveyed by means of a feeding device to an opener roller located in a housing and is separated by the opener roller into individual fibers which are conveyed through a fiber feeding channel to the fiber collection surface by means of a conveying air stream, as well as to a device to carry out this process.

To provide the outlet of a channel between the inlet opening into the fiber feeding channel and an opening in the peripheral wall of the opener roller housing receiving the feeding device as seen in the direction of rotation of the opener roller, the channel letting out into the fiber feeding channel between the inlet opening and the spinning element, is known from DE 39 10 29 A1. Clogging of the opener roller and a resulting impairment of the opening process is to be prevented in this manner. This device is very expensive and is difficult to produce. Also, changes for adaptation to different conditions cannot be made.

OBJECTS AND SUMMARY OF THE INVENTION

It is a principal object of the present invention to create a process and a device which avoids in a simple manner fly fiber in the vicinity of the opening receiving the feeding device. Additional objects and advantages of the invention will be set forth in the following description, or will be obvious therefrom, or may be learned from practice of the invention.

The objects are attained through the invention in that an auxiliary air flow, which is contrary to the direction of rotation of the opener roller and sufficiently strong to remove the fiber fragments detached from the opener roller and circling, is produced in the immediate vicinity of the feeding device and as far as the inlet into the fiber feeding channel. This air flow does not leave the opener roller housing before it enters the fiber feeding channel. The conditions required for a simple device are thus created.

In order for the auxiliary air flow to be able to produce the desired energy without requiring extremely high overpressure in the spinning element, the auxiliary air flow is conveyed to the fiber feeding channel over a width which is substantially equal to the width of the clothing of the opener roller.

In order to improve the orientation of the fibers as they are conveyed to the fiber collection surface of the spinning element, the fibers fed into the fiber feeding channel are preferably detached from the wall of the fiber feeding channel which is across from the opener roller and the auxiliary air flow introduced into the fiber feeding channel in the opposite direction of the sense of rotation of the opener roller is conveyed along the wall across from the wall from which the fibers have been detached. It is an advantage in this case if the fibers detached from the wall of the fiber feeding channel are conveyed in the direction of the zone inside the fiber feeding channel in which the conveying air stream and the auxiliary air stream are brought together.

In another advantageous embodiment of the invention, the auxiliary air stream is directed essentially in a radial direction against the delivery roller of the feeding device as it enters the housing containing the opener roller in order to prevent fibers and fiber fragments from settling in the corrugations of the delivery roller.

To carry out this process, the invention provides for an air conveying channel extending from the immediate vicinity of the opening in the housing which receives the feeding device to the inlet opening of the fiber feeding channel, in the area between inlet opening of the fiber feeding channel and the feeding device (as seen in the direction of rotation of the opener roller) in the peripheral wall of the housing toward the opener roller. All the fibers and fiber fragments which have been detached from the clothing of the opener roller but have not already left the opener roller housing through the fiber feeding channel are brought by the above-mentioned air flow through the air guiding channel, from the housing opening receiving the feeding device to the fiber feeding channel, from where they reach the spinning element and are incorporated there into the forming yarn. Since these fibers and fiber fragments do not accumulate and cannot arrive at the spinning element in the form of a fiber accumulation, they do not interfere in the spinning process. Furthermore, the filling of the machine with fly fiber, in particular near the feeding device, is counteracted.

It has been shown to be advantageous to obtain a strong flow in the vicinity of the feeding device and, in order to avoid fly fiber as well as to influence the flow of fibers in the fiber feeding channel, for the air conveying channel to be of a width which is approximately equal to that of the opener roller.

It is not necessary for the air conveying channel to extend as far as into the opening for the feeding device. Preferably, the air conveying channel is even separated from the opening receiving the feeding device by a short wall segment. It has been shown to be advantageous here for the wall segment to be of a length equal to one to four times the depth of the air conveying channel (as seen in the radial direction in relation to the opener roller).

In an advantageous embodiment of the invention, the air conveying channel is separated by an intermediary wall from the interior of the housing, at least in its area toward the fiber feeding channel. In such a design of the device according to the invention, it is advantageous if a convex intake convexity is provided at the end of the air conveying channel toward the feeding device, the maximum depth of this convexity being essentially twice the depth of the air conveying channel, the convexity being covered by the intermediate wall starting at the fiber feeding channel, basically as far as the center, separating it from the interior of the housing.

To attach and hold the intermediate wall, a groove is preferably provided in the closed lateral wall of the housing to position the intermediate wall, it being possible to provide a groove which interacts with the intermediate wall in the removable face wall which covers the open front of the housing. In an alternative simpler embodiment of the invention, the intermediate wall is constituted by a pot-like insert of the housing in which the technologically required openings such as fiber feeding opening, dirt collection opening and inlet opening into the fiber feeding channel are provided.

It has been shown to be especially advantageous to design the intermediate wall so that it extends as far as into the inlet opening of the fiber feeding channel and is oriented with its end into the longitudinal direction of the said channel.

The auxiliary air stream fed to the fiber feeding channel in a direction contrary to the direction of rotation of the opener roller can also be used to influence the fly fibers in the fiber feeding channel. For this purpose, another advantageous characteristic of the invention provides for a convex curve to be provided in the wall of the inlet opening of the fiber feeding channel across from the air conveying channel and that a tangent applied to the concave peripheral wall of the housing which precedes the end of the convex curve intersect the wall of the fiber feeding channel toward the air conveying channel. This causes the fibers in the fiber feeding channel to be lifted from the wall across from the inlet of the air conveying channel into the fiber feeding wall without reaching the wall of the fiber feeding channel toward the air conveying channel. It is advantageous in this case if the tangent intersects the zone in which the conveying air stream unites with the auxiliary air stream.

Air eddies in the auxiliary air stream conveyed from the air conveying channel to the fiber feeding channel should be avoided as much as possible so as not to impair the fiber orientation. For this reason a rounded edge is advantageously provided at the inlet from the air conveying channel into the fiber feeding channel.

In order to effectively prevent detached fiber fragments which circle together with the opener roller and tend to leave the opener roller housing through the opening receiving the feeding device from doing so, it is possible to provide in another embodiment of the invention for a rounded edge at the passage from the opening receiving the feeding device into the air conveying channel or into the peripheral wall of the housing provided between the air conveying channel and the opening.

In order to clean the corrugations of the feeding roller by means of the air flowing into the opener roller housing it is advantageous if the opening becomes wider at its side away from the opener roller. The air is thereby oriented essentially in a radial direction with respect to the feeding roller and thus penetrates into the corrugations of the feeding roller. In this case a wall which closely surrounds the feeding roller of the feeding device is preferably provided between the interior of the housing and the exterior of the opening, this wall extending over an area of less than eight corrugations provided in the feeding roller.

In order to avoid interference in air management in the opener roller housing free space between the opener roller and the peripheral wall of the housing surrounding, the opener roller and the cross-sectional surface of the air conveying channel is advantageously sized so that together they may yield the desired overall air flow in the fiber feeding channel for a given negative spinning pressure.

Clogging due to fly fibers in the area of the feeding device as well as inside and outside the opener roller housing is effectively avoided by means of the invention. This is due to the fact that short fibers and fiber fragments which are prevented from continued circling by the fiber tuft extending toward the opener roller and which are detached from the opener roller are fed back into the normal fiber conveying path and neither accumulate in the area of the feeding device nor are able to leave the opener roller housing at that location. This results in reduced yarn breakage, since by preventing the fibers from accumulating, they are prevented from becoming detached and from reaching the spinning element in form of fiber clots.

The invention is explained in further detail below through examples of preferred embodiments.

DETAILED DESCRIPTION OF THE PREFERRED EMBODIMENTS

Figure 1:
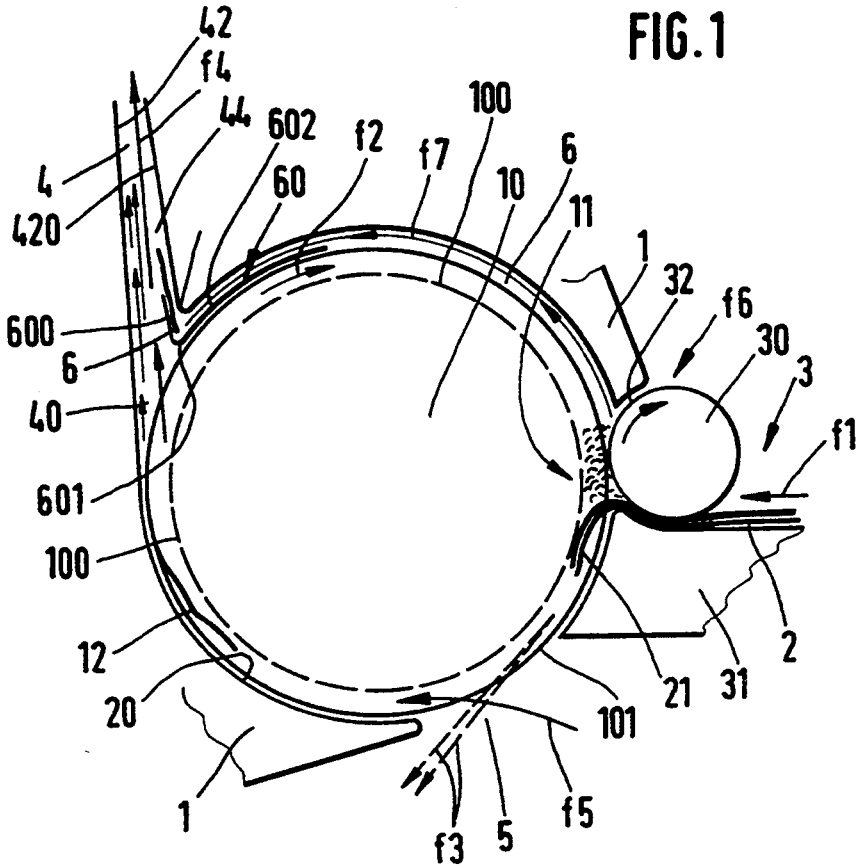
FIG. 1 shows an opener roller housing designed in accordance with the invention, in a side view.

Reference will now be made in detail to the presently preferred embodiments of the invention, one or more examples of which are illustrated in the drawings. Each example is provided by way of explanation of the invention, not limitation of the invention. The numbering of components is consistent throughout the application, with the same components having the same numbers throughout.

FIG. 1 shows an opener roller housing 1 with an opener roller 10. The latter is provided with a circumferential surface provided with a clothing between two end disks which may form an integral part of the opener roller 10. The root circle 100 of this clothing is represented in FIG. 1 by a broken line while the addendum circle 101 is represented by a solid line.

Fiber material in the form of a fiber sliver 2 is fed by means of a feeding device 3 to the opener roller 10 in the direction of the arrow f1. The feeding device is equipped with a delivery roller 30 as well as with a feeding trough 31 interacting elastically with the latter. The feeding device 3 is installed in an opening 11 in the peripheral wall 12 of the opener roller housing 1.

The opener roller 10 rotates during operation in the direction of arrow f2 and thereby conveys the fiber 20 separated from the leading end of the fiber sliver 2 into a fiber feeding channel 4 through which the fibers 20 are fed by means of a conveying air stream to an open-end spinning element which is not shown.

In the direction of fiber conveying (arrow f2), between the feeding device 3 and the fiber feeding channel 4, a dirt collection opening 5 through which dirt particles detached from the fibers 20 are eliminated (see arrow f3) is provided in the peripheral wall 12 of the housing 1.

In the open-end spinning element which is not shown, relatively great negative pressure is applied, causing air to be aspired through the fiber feeding channel 4. This is indicated by arrow f4. The major portion of this air is aspired through the dirt collection opening 5 (see arrow f5). A smaller portion of the air is aspired through the opening 11 in the opener roller housing 1 (arrow f6).

Before explaining in further detail how the air aspired through the opening 11 into the opener roller housing 1 gets into the fiber feeding channel 4, the design of the housing 1 in the direction of rotation of the opener roller 10 (see arrow f2) after the entry into the fiber feeding channel 4 will be described. In the area between the inlet opening 40 of the fiber feeding channel 4 and the opening 11 which receives the feeding device 3, the peripheral wall 12 of the housing 1 is at a greater radial distance from the addendum circle 101 of the opener roller 10 than in the peripheral area between the feeding device 3 and the fiber feeding channel 4. This greater radial distance can extend over the entire width of the opener roller housing 1, as is the case in the embodiment of FIG. 1, or merely over part of this width, so that an air conveying channel 6 with a width that is essentially equal to the width of the clothing of the opener roller 10 is defined.

This air conveying channel 6 is thus located in the peripheral wall of housing 1 toward the opener roller 10 and extends (in relation to the auxiliary air stream flowing in the air conveying channel 6 along the direction of rotation of the opener roller 10) from the immediate proximity of the opening which receives the feeding device 3 to the inlet opening 40 of the fiber feeding channel 4.

Even if this increased distance extends over the entire width of the opener roller housing 1, as is shown in FIG. 1, this is also called hereinafter an air conveying channel 6 in the sense of the invention. The reason for this becomes apparent from the description below.

As the opener roller 10 rotates in the opener roller housing 1, a circulation flow is produced. A portion of it emerges, as mentioned, through the fiber feeding channel 4 and at the same time carries the fibers 20 which have become detached in the meantime from the clothing of the opener roller 10 with it. There are however fibers 20 and fiber fragments which were unable to detach themselves from the clothing, perhaps because they were embedded more deeply in the clothing than the fibers 20 which have entered the fiber feeding channel 4, and which are conveyed between the teeth of the clothing in the direction of the feeding device 3. At this location the leading end of the fiber sliver, in the form of a fiber tuft 21, extends into the area between the clothing teeth and thus bars the way to the air flow circling together with the opener roller 10. The air now tries to emerge from housing 1 through the gap 32 left between the delivery roller 30 and the housing wall to escape.

Thanks to the air conveying channel 6 between the fiber feeding channel 4 and the feeding device 3, the friction losses are kept low, so that an air flow directed contrary to the direction of rotation (arrow f2) of the opener roller 10 builds up in the vicinity of the air conveying channel 6. If the flow losses are so low that a stronger air stream is produced in the direction of arrow f7, this air stream is so strong that air enters the opener roller housing 1 through the gap 32 in the direction of arrow f6. The fibers 20 and fiber fragments which had been prevented by the fiber tuft 21 extending toward the opener roller 10 from being conveyed on in the direction of arrow f2 in the housing 1, and which tend therefore to accumulate in the vicinity of the opening 11 and thereby of the feeding device 3, are brought by this air stream flowing into the opener roller housing 1 from here to the fiber feeding channel 4 in direction of arrow f7, contrary to the direction of rotation f2 of the opener roller 10. Accumulations of fibers 20 and fiber fragments are thus avoided in the vicinity of the feeding device 3. Therefore, fly fiber clogging can occur neither inside nor outside the housing 1, since the fiber fragments etc. can neither accumulate here, nor can they emerge from the housing 1.

As FIG. 1 shows, the air conveying channel 6 is separated from the remainder of the interior of the housing 1 by an intermediate wall 60 in the area toward the fiber feeding channel. The intermediate wall 60 is provided with a segment 600 extending into the inlet opening 40 of the fiber feeding channel 4, oriented in the longitudinal direction of the fiber feeding channel 4 and connected to the main segment 602 via a curved intermediate segment 601. The auxiliary air stream which is conveyed in the direction of arrow f7 to the fiber feeding channel 4, and which carries fiber fragments and dust particles with it, is deflected by this intermediate wall 60 in the direction of the fiber feeding channel 4 in such manner as to avoid turbulence at that location. The width of the air conveying channel 6 is here constantly and essentially equal to the width of the clothing of the opener roller 10 over its entire length, so that a correspondingly wide auxiliary air stream is maintained as far as into the fiber feeding channel 4.

Figure 2:
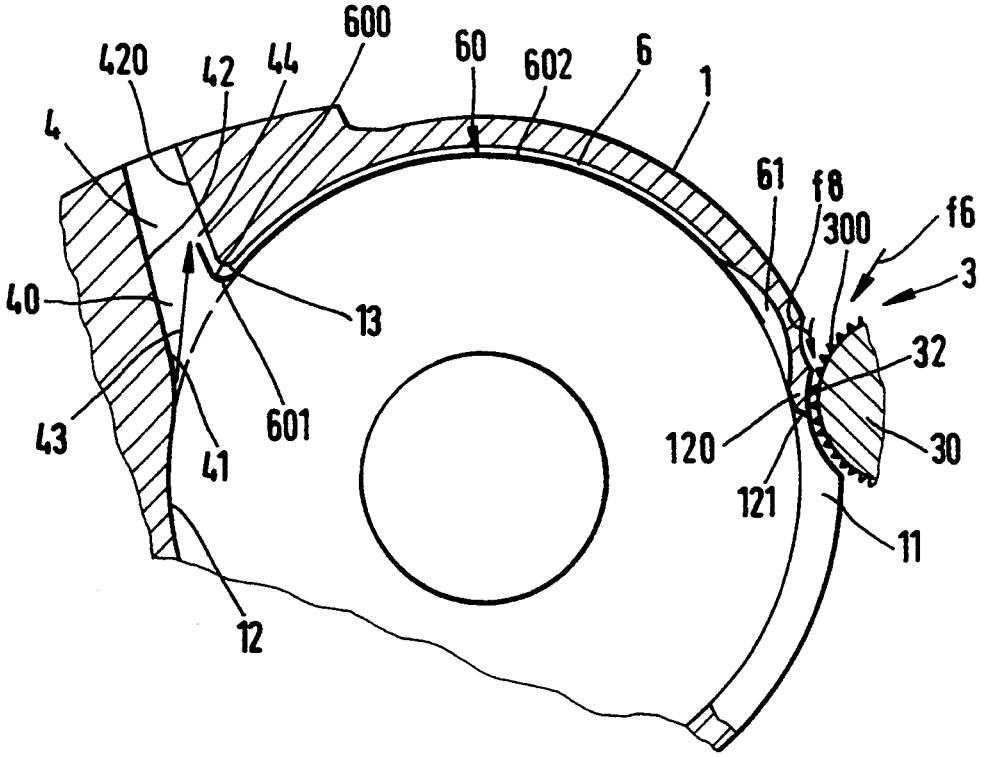
FIG. 2 shows a detail of a modified opener roller housing in a side view.

FIG. 2 shows an enlarged representation of a variant of the device shown in FIG. 1, in which the intermediate wall 60 of the air conveying channel 6 not only extends over an area toward the fiber feeding channel 4, so that the air conveying channel 6 is separated in its area toward the fiber feeding channel 4 from the interior of the opener roller housing 1, but the intermediate wall 60 extends in this embodiment as far as into proximity of the feeding device 3, so that a closed channel is formed from there into the fiber feeding channel 4. In addition, a short wall segment 120 is provided between housing 1 and delivery roller 30, between opening 11 and the inlet into the air conveying channel 6 so as to form a gap 32 of sufficient length, separating the air conveying channel 6 from the opening 11.

In order to avoid air eddies in the vicinity of the feeding device 3 at the inlet into the air conveying channel 6 as a result of a tearing edge which may form, a bulging (convex) widening 61 is provided in the opener roller housing 1 at this location as shown in FIG. 2. The air which is unable to enter the air conveying channel 6 directly from the feeding device 3 but must pass the wall segment 120 of the opener roller housing 1 for this, then enters the convex inlet bulge (bulge-like widening 61) and is gradually returned to the cross-section of air conveying channel 6.

The convex widening 61 has essentially the shape of a half-cylinder and has a maximum depth which is approximately twice the depth of the air conveying channel 6. Approximately one half of the convex widening is separated on its side toward the fiber feeding channel 4 by the intermediate wall 60 from the interior of housing 1. This type of covering of the convex widening produces an air flow essentially without tearing edge, so that the pressure loss can be kept down, this being important for a strong and effective auxiliary air stream flowing in the air conveying channel 6.

The wall segment 120 should not be too long (as seen in the peripheral direction of the opener roller 10) in order to achieve a strong auxiliary air stream. A length equal to one to four times the depth (in radial direction with respect to the opener roller 10) of the air conveying channel 6 has proven to be advantageous. Thanks to this relatively short wall segment 120 (although it is a precondition that the air conveying channel 6 extend into the immediate proximity of the opening 11, it need not necessarily go as far as into this opening 11) the auxiliary air stream flowing in the air conveying channel 6 acts as far as in the area in which fiber accumulations may occur. Even with a very narrow gap 32, sufficient air is available for the auxiliary air stream, since the air circling with the opener roller 10 is prevented by the fiber tuft 21 which constitutes a "curtain" from continuing to circle with the opener roller 10 and must be removed in some other manner. This occurs as mentioned in the form of the auxiliary air stream.

According to FIG. 1, the shown left wall of the fiber feeding channel 4 merges tangentially into the peripheral wall of housing 1. In contrast to this, the fiber feeding channel 4 does not extend tangentially away from the opener roller 10 according to FIG. 2, but has a certain slope so that the direction of flow in the fiber feeding channel 4 has a certain radial component. The passage from the concave peripheral wall 12 of the opener roller housing 1 into the fiber feeding channel 4 takes place in this case via a convex surface 41 which causes the fibers 20 to become detached from the wall 42 of the fiber feeding channel 4 across from the opener roller and are conveyed more toward the center of the fiber feeding channel 4, where the air flow speed is higher in relation to the channel wall zones. The design is such that a tangent 43 applied to the passage from the concave peripheral wall 12 of the opener roller housing 1 into the concave surface 41 intersects the wall 420 of the fiber feeding channel 4 toward the air conveying channel 6, and in this case in such manner that this tangent 43 intersects the zone 44 in which the conveying air stream fed to the fiber feeding channel 4 through the inlet opening 40 is united with the auxiliary air stream fed through the air conveying channel 6. The air flow forming along the wall 420 which is across from the wall 42 of the fiber feeding channel 4 prevents the fibers 20 from sliding along wall 420 of the fiber feeding channel 4, and instead holds them at a distance from this wall 420. As a result, the fibers 20 are conveyed in the fiber feeding channel 4 at a distance from the wall 42 as well as from the wall 420, this being of considerable significance for the stretching of the fibers and thereby for the orientation of the fibers 20 which reach the spinning element to be spun.

It is not required here, and often not even desirable, for the fibers 20 to actually reach this zone 44, since the auxiliary air stream merely has a safety function. In order for this auxiliary air stream to accomplish its task however, the fibers 20 conveyed by the conveying air stream are conveyed in a direction oriented toward zone 44 after leaving the peripheral wall 12 of the opener roller 10 (tangent 43).

A certain quantity of air is needed to convey fibers 20 to the spinning element. It is therefore important to coordinate air management in the opener roller housing 1 for this. By comparison with known designs, in which no air conveying channel 6 was provided, no other global air quantity is on the whole required in the fiber feeding channel 4. But since a portion of the air should enter the opener roller housing 1 through the gap 32 (arrow f6), this portion of the air must be deducted from the quantity of air which is sucked away through the dirt collection opening 5.

This division of air is achieved in that the distance between the peripheral wall 12 of the opener roller housing 1 and the opener roller 10, i.e. the free space between the opener roller 10 and the peripheral wall of housing 1 surrounding the opener roller 10 is decreased between the dirt collection opening 5 and the inlet opening 40 into the fiber feeding channel 4 so as to produce somewhat smaller cross-sections. In this manner, less air can be conveyed between the peripheral wall 12 of the housing 1 and the opener roller 10 than in the conventional designs, so that the air sucked through the fiber feeding channel 4 toward the spinning element must cover part of its requirement through the gap 32. The air conveying channel 6 extending from there to the fiber feeding channel 4 is sized in such manner in relation to the above-mentioned free space that the free space and the air conveying channel 6 together yield the desired total air flow (with a given negative pressure in the fiber feeding channel 4).

As FIG. 2 shows, the delivery roller 30 has a corrugated surface 300. The case may occur that fiber fragments, dirt, and dust particles settle between the corrugations of this corrugated surface 300 and then continue to rotate over and over again with the delivery roller 30. An air stream flowing along the feeding device 3 in a substantially tangential direction and which enters the interior of the opener roller housing 1, cannot fetch out such fiber fragments etc. from between the corrugations of the corrugated surface 300. In order to nevertheless detach such fiber fragments etc. from the corrugated surface 300 of the delivery roller 30, an essentially radial air stream (see f8) is produced according to FIG. 2, capable of penetrating through this orientation between the corrugations of the corrugated surface 300 of the delivery roller 30. Thereby this air acts upon the fiber fragments etc. that may be caught on this surface 300 and detaches them from this surface 300, so that the air stream flowing into the housing 1 carries along these fiber fragments etc. into the housing 1.

As shown in FIG. 2, this essentially radial air stream (in relation to the delivery roller 30 from which fiber fragments that may have been caught are to be detached) is produced due to the fact that the opening widens from gap 32 to its side away from the opener roller 10 in such manner that the outer housing wall following the gap 32 extends essentially radially in relation to the delivery roller 30. The recess on the outside of housing 1 to produce an air stream flowing essentially in a radial direction toward the delivery roller 30 also makes it possible to obtain a strong air stream directed into housing 1 without any need for the air stream to be throttled by an overlong gap 32 in that the gap 32 is delimited between the inside and the outside of housing 1 by a wall which closely surrounds the delivery roller 30, while this wall extends however only over a peripheral area of less than eight corrugations of the delivery roller 30.

Even if these fiber fragments travel from the vicinity of the feeding device 3 into the fiber feeding channel 4 and thereby also reach the spinning element where they are incorporated into the newly spun yarn, these few fiber fragments, etc. do not increase the risk of yarn breakage. The reason for this is that the number and frequency of the fiber fragments are so minimal that they cannot affect the strength of the yarn produced.

In order to keep the pressure losses as low as possible in the air which enters the opener roller housing through gap 32, the edge 121 of the wall 120 of the opener roller housing 1 toward opening 11 is rounded off. It does not matter here whether this edge 121 merges directly into the air conveying channel 6 or into the wall segment 120 between opening 11 and air conveying channel 6. Edge 13, located at the inlet of the air conveying channel 6 into the fiber feeding channel 4 is also rounded off according to FIG. 2 in order to keep the pressure losses in the air conveying channel 6 as low as possible. Furthermore, turbulence having an effect as far as into zone 44 and which may thus have a detrimental effect on the fibers 20 is to be avoided here.

The intermediate wall 60 which is shown in FIGS. 1 and 2 is held in an appropriately designed groove in the closed face wall of the housing 1 which surrounds the opener roller 10, i.e. in the wall which is an integral part of the housing 1. The intermediate wall 60 can be held and positioned in the groove by pressing it into the groove or also by bonding. Similarly, the removable cover of the opener roller housing 1 can also be provided with such a groove to receive the intermediate wall 60, whereby this groove must be somewhat wider than the one which is located in the face wall which is an integral part of housing 1, since it must be possible to remove this cover from the opener roller housing 1. The two grooves act together, in that they hold and position the intermediate wall 60 together.

Figure 3:
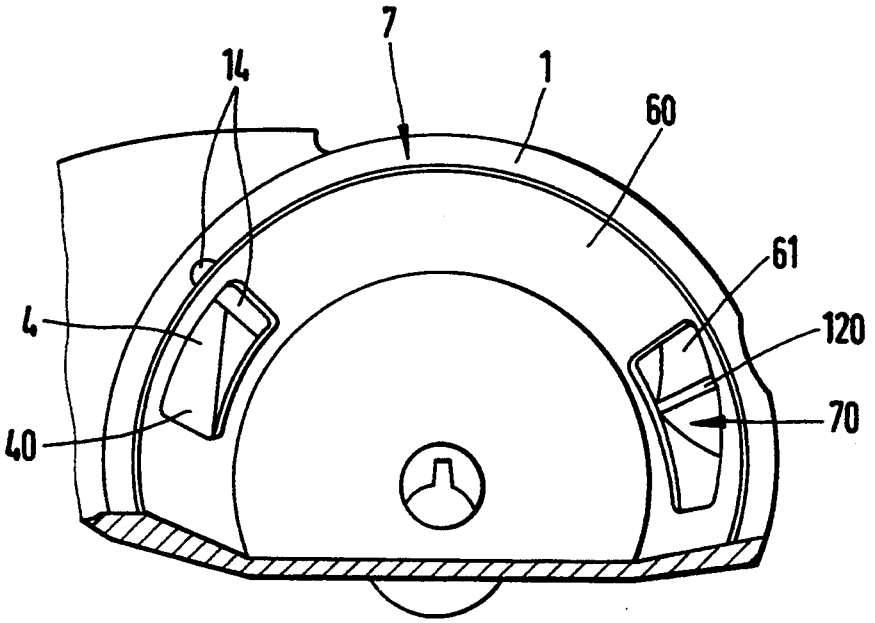
FIG. 3 shows another embodiment of an opener roller housing according to the invention, in perspective.

The instant invention is not limited to the shown and discussed forms and designs. Within the framework of the invention, processes and devices can be subject to unlimited variations, e.g. through the replacement of characteristics by equivalents or through other combinations of characteristics. One such variant is shown in FIG. 3. In this embodiment the entire interior of the opener roller housing 1 is lined with a pot-like insert 7 which is provided with the technologically required openings in a known manner (opening 11 of the fiber feed, dirt collection opening 5 and the opening at the inlet 40 into the fiber feeding channel 4). Thus a recess 70 is provided in the vicinity of opening 11, extending into area of the bulge-like widening 61 and separated by a segment of wall 120 from the opening 11, as is also the case in the embodiment of FIG. 2.

The air conveying channel 6 in this embodiment is located between the enlarged inner peripheral wall of housing 1 and the outer wall of insert 7 and is of a width which is less than the width of insert 7 and thus of the interior of housing 1. The pot-like insert 7 thus constitutes the intermediate wall 60 in the area of the air conveying channel 6.

At the passage between the air conveying channel 6, which is not shown in FIG. 3, and the fiber feeding channel 4, at the location where the intermediate segment 601 of the intermediate wall 60 is located as shown in FIG. 1, a half-round ceramic pin 14 is installed and serves on the one hand as a wear protection and on the other hand causes a deflection of the auxiliary air stream flowing in the air conveying channel 6 in the direction of the fiber feeding channel 4 into the fiber feeding channel 4.

Figure 4:
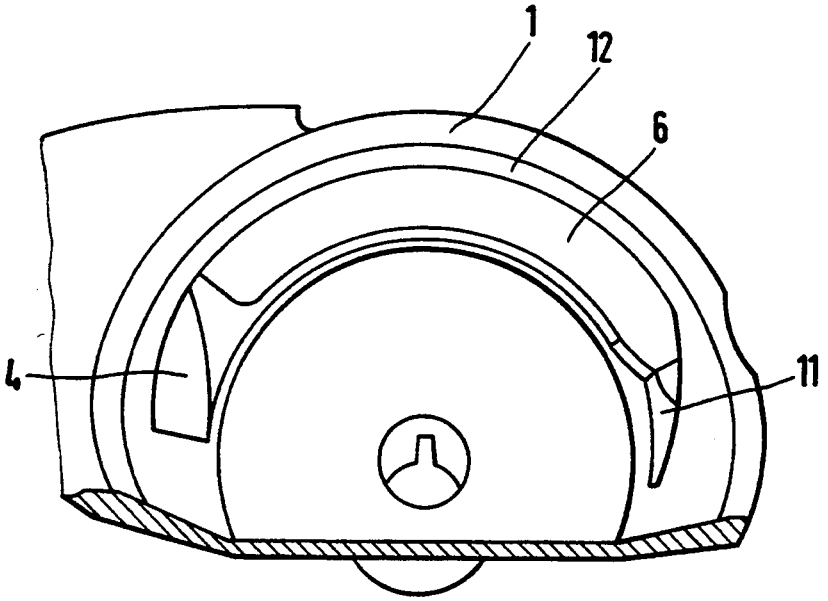
FIG. 4 shows yet another embodiment of an opener roller housing in perspective.

Even though an intermediate wall 60 in the form of an insertion plate or a pot-shaped insert 7 has been provided in the embodiments described so far, this is not an absolute condition. As shown in FIG. 4, the pot-like insert 7 or some other intermediate wall 60 can also be omitted, so that the air conveying channel 6 is separated by no intermediate wall 60 from the interior of the opener roller housing 1 which contains the opener roller 10. This air conveying channel 6 is located in an enlarged peripheral area of the opener roller housing 1, its depth being sufficiently great so that pressure losses are low. As was already mentioned in connection with the other embodiments, here too fiber accumulations in the area of opening 1 are avoided inside and outside the opener roller housing 1, as the auxiliary air stream flowing into the opener roller housing 1 through the gap 32 in opening 11 seizes all detached fiber fragments etc. which are circling with the opener roller 10 and conveys them through the air conveying channel 6 into the fiber feeding channel 4.

As FIGS. 3 and 4 show, the opening 11 is narrower than the air conveying channel 6. This is caused by the fact that the fiber sliver 2 is fed to the opener roller 10 over a narrower width than the width of the clothing so as to ensure that no fibers 20 can settle in the outside zone of the opener roller 10. The width of the fiber feeding channel 4 is greater than the feeding width of the fiber sliver 2 to the opener roller 10 so that all the fibers, even those which are in the outermost conveying range of the opener roller 10, can be removed through this fiber feeding channel 4. The width of the fiber feeding channel 4 (and also of the air conveying channel 6) is exactly the same as the width of the clothing of the opener roller 10. This appears clearly from FIGS. 3 and 4.

The auxiliary air stream entering the air conveying channel 6 is influenced by the fact that the fiber feeding channel 4 is wider than the opening 11 so that the flow speed is greatest in proximity of the feeding device and so that the locations at which fibers and fiber fragments are most likely to settle are subjected to an especially strong air flow. The narrow gap 32 has an equally advantageous effect, since the narrowness of gap 32 leads to high air speed.

It will be apparent to those skilled in the art that various modifications and variations can be made in the invention without departing from the scope or spirit of the invention. It is intended that the present invention such modifications and variations as come within the scope of the appended claims and their equivalents.

I claim:

1. A process for pneumatic feeding of fibers to a fiber collection surface of an open-end spinning element, the fibers having been fed in the form of a fiber tuft of a fiber sliver by a feeding device for being opened into individual fibers by clothing of an opener roller having a predetermined width and drawn through a housing around the opener roller to a fiber feeding channel, said process comprising the steps of:

conveying the fibers opened from the fiber tuft in a rotational direction of the opener roller along a section of a peripheral fiber guiding wall of the opener roller housing, the fibers being conveyed between the opener roller and the housing by means of a conveying airstream;

defining and directing an auxiliary airstream along a portion of the peripheral fiber guiding wall from generally adjacent the feeding device to an inlet of the fiber feeding channel in a direction generally opposite the rotational direction of the opener roller; and maintaining the auxiliary airstream at such a strength so that fibers and fiber fragments conveyed past the fiber feeding channel in the direction of rotation of the opener roller are drawn back to the fiber feeding channel by way of the auxiliary airstream.

2. The process as in claim 1, including defining the auxiliary airstream over a width which is substantially equal to the width of the clothing of the opener roller.

3. The process as in claim 1, including directing the auxiliary airstream into the fiber feeding channel along a far wall of the fiber feeding channel in the rotational direction of the opener roller.

4. The process as in claim 3, including directing the auxiliary airstream within the fiber feeding channel so as to admix with the conveying airstream in a zone between both walls of the fiber feeding channel.

5. The process as in claim 1, including drawing the auxiliary airstream from around at least a portion of the delivery roller of the feeding device, the auxiliary airstream thereby having a radial component tending to clean the delivery roller.

6. A device for pneumatic feeding of fibers to a fiber collection surface of an open-end spinning element, comprising:

an opener roller provided with a clothing of predetermined width installed in a housing, said housing and said opener roller defining a fiber-guiding channel generally surrounding said opener roller;

a fiber feeding channel extending from a peripheral wall of said housing and defined by a first wall and a second wall in the rotational direction of said opener roller;

a feeding device disposed at least in part in an opening in said housing for feeding a fiber sliver to said opener roller, said housing and said opener roller defining a main fiber conveying channel between said feeding device and said fiber feeding channel with respect to a direction of rotation of said opener roller; and an auxiliary fiber conveying channel defined along a portion of said housing from generally immediately adjacent said feeding device to said fiber feeding channel in a direction opposite the direction of rotation of said opener roller, said auxiliary fiber conveying channel configured for directing an auxiliary airstream from adjacent said feeding device to said fiber feeding channel in a direction which is opposite the direction of rotation of the opener roller.

7. The device as in claim 6, wherein said auxiliary fiber conveying channel comprises a width which is essentially equal to the width of said clothing of said opener roller.

8. The device as in claim 6, including an opening in said housing accommodating said feeding device, and a relatively short wall segment disposed so as to separate said auxiliary fiber conveying channel from said opening.

9. The device as in claim 8, wherein said short wall segment has a radial depth of from one to four times that of said auxiliary fiber conveying channel.

10. The device as in claim 6, wherein said auxiliary fiber conveying channel is defined at least in the vicinity of said fiber feeding channel by an intermediate wall disposed between said housing and said opener roller.

11. The device as in claim 10, wherein said auxiliary fiber conveying channel defines a convex section generally adjacent said feeding device, said intermediate wall extending from said fiber feeding channel to generally at least a mid point of said convex section in the direction of rotation of said opener roller.

12. The device as in claim 11, wherein said convex section comprises a radial depth of generally twice the radial depth of said auxiliary fiber conveying channel.

13. The device as in claim 10, wherein said housing comprises a grooved defined therein for accommodating said intermediate wall.

14. The device as in claim 10, wherein said intermediate wall is defined by an insert fitted into said housing, said insert comprising openings aligned with said fiber feeding channel and said opening for said feeding device.

15. The device as in claim 10, wherein said intermediate wall extends comprises a segment extending into said fiber feeding channel, said segment longitudinally aligned with said fiber feeding channel.

16. The device as in claim 15, wherein said intermediate wall comprises a rounded corner where said segment extends into said fiber feeding channel.

* * * * *